US006431915B1

(12) United States Patent
Ko

(10) Patent No.: US 6,431,915 B1
(45) Date of Patent: Aug. 13, 2002

(54) RF CABLE CONNECTOR ASSEMBLY FOR PREVENTING MIS-MATING

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/955,435

(22) Filed: Sep. 10, 2001

(51) Int. Cl.[7] ..... H01R 13/648
(52) U.S. Cl. ..... 439/610; 439/581; 439/63
(58) Field of Search ..... 439/578–585, 439/607, 63, 610

(56) References Cited

U.S. PATENT DOCUMENTS 4,795,352 A * 1/1989 Capp et al. ..... 439/63
5,055,068 A * 10/1991 Machina et al. ..... 439/581
5,180,315 A * 1/1993 Nagashima ..... 439/581
5,984,696 A * 11/1999 Lee ..... 439/63
6,305,947 B1 * 10/2001 Bruce ..... 439/63

* cited by examiner

*Primary Examiner*—Hien Vu
(74) *Attorney, Agent, or Firm*—Wei Te Chung

(57) ABSTRACT

A radio frequency transmitting system comprises first and second cable connector assemblies. The first cable connector assembly includes a first plug connector (8) having a spacer (1) mounted therearound, and a first receptacle connector (22). The first receptacle connector has a ground shell (24), and two tabs (26) depending from opposite sides of the ground shell. The second cable connector assembly includes a second plug connector mechanically identical to the first plug connector, and a second receptacle connector (16). The second receptacle connector is mechanically identical to the first receptacle connector except that two tabs (20) depending from opposite sides of a ground shell (18) of the second receptacle connector depend further than the tabs of the first receptacle connector. Therefore the second receptacle connector cannot be electrically engaged with the first plug connector, due to interference between the tabs of the second receptacle connector and the spacer.

3 Claims, 4 Drawing Sheets

RF CABLE CONNECTOR ASSEMBLY FOR PREVENTING MIS-MATING

FIELD OF THE INVENTION

The present invention relates to RF cable connector assemblies, and especially to RF cable connector assemblies which can prevent incorrect mating of a plug connector with a receptacle connector.

BACKGROUND OF THE INVENTION

RF cable connectors are often used for transmitting radio frequency (RF) signals, and an RF cable connector assembly normally has a plug connector to mate with a complementary receptacle connector. When a system needs to use two RF cable connector assemblies to transmit two different frequencies, mis-mating may occur.

Two RF cable connector assemblies used together commonly have identical mechanical configurations. Thus, for example, a receptacle connector for high frequency use such as 6 GHz may be inadvertently connected with a plug connector for low frequency use such as 3 GHz. This renders the system unworkable. To safeguard a specific assembly, the mechanical configuration of either or both of the connectors can be altered. However, this is costly and therefore often not commercially feasible.

Hence it is desired to provide an RF transmitting system comprising two RF cable connector assemblies having simple mechanical configurations that prevents incorrect mating of a plug connector with a receptacle connector.

SUMMARY OF THE INVENTION

An objective of the present invention is to provide an RF transmitting system including a first connector assembly for low frequency use and a second connector assembly for high frequency use, wherein connectors of the RF transmitting system are prevented from mis-mating and such prevention is achieved in a cost-effective manner.

An RF transmitting system in accordance with the prevent invention comprises a first and a second cable connector assembly. The first and second cable connector assemblies are adapted for use in different frequencies from each other. The first cable connector assembly includes a first plug connector having a spacer mounted therearound, and a first receptacle connector. The first receptacle connector has a ground shell, and a pair of tabs depending from opposite sides of the ground shell. The second cable connector assembly includes a second plug connector mechanically identical to the first plug connector, and a second receptacle connector. The second receptacle connector is mechanically identical to the first receptacle connector, except that a pair of tabs depending from opposite sides of a ground shell of the second receptacle connector depends further than the pair of tabs of the first receptacle connector. Therefore the second receptacle connector cannot be electrically engaged with the first plug connector, due to interference between the tabs of the second receptacle connector and the spacer.

Further objects and advantages of the present invention will become more apparent from a consideration of the drawings and the ensuing detailed description.

DETAILED DESCRIPTION OF THE INVENTION

Figure 1:
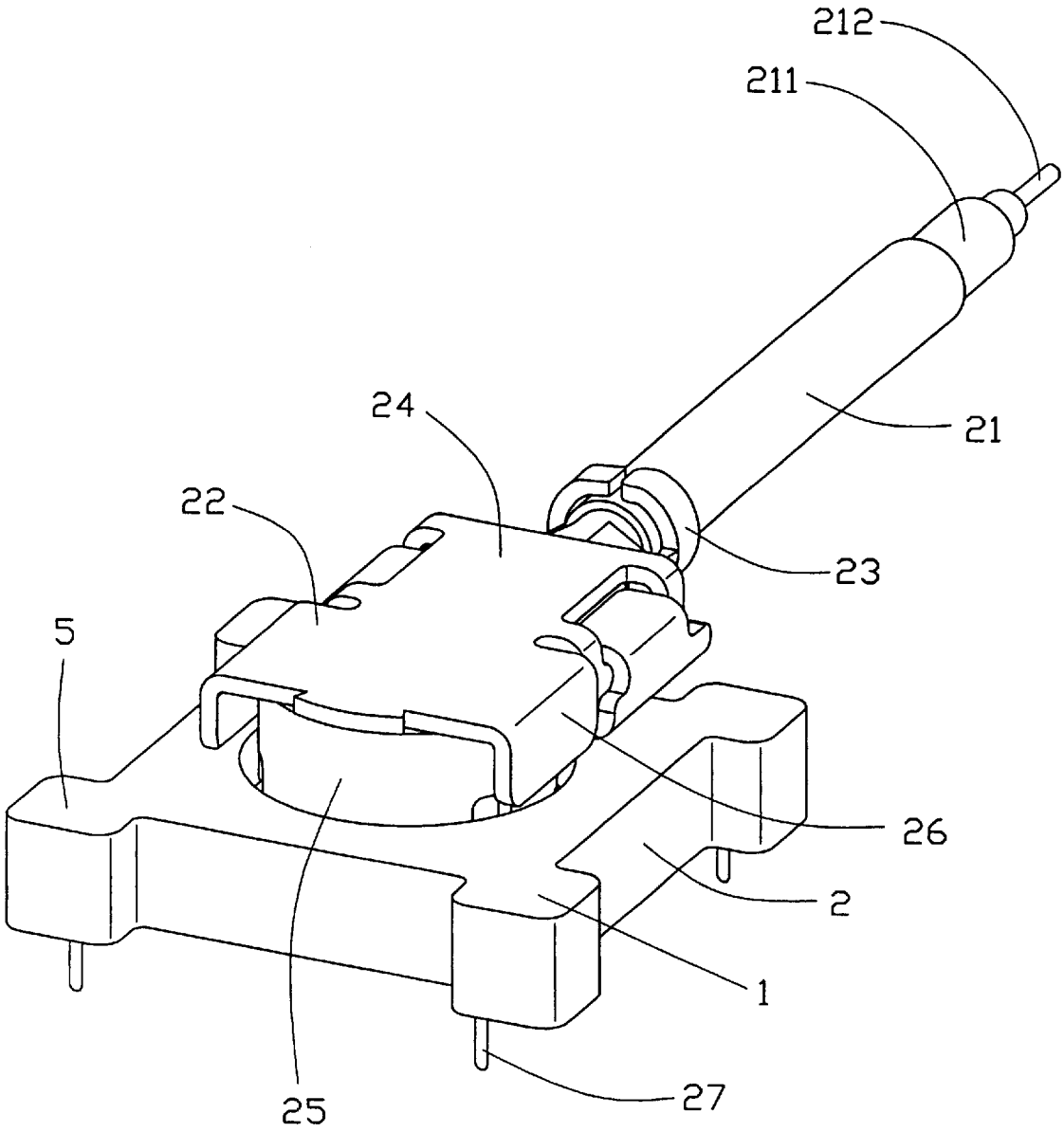
FIG. 1 is a perspective view of a first RF cable connector assembly with a spacer according to the present invention.

Referring now to the drawings in detail, FIG. 1 shows a first RF cable connector assembly with a spacer 1 in accordance with the present invention. The first RF cable connector assembly comprises a first plug connector 8 (see FIG. 3) and a first receptacle connector 22. The spacer 1 is mounted around the first plug connector 8 (see especially FIG. 4). The first receptacle connector 22 includes a terminal 25 for mating with a header 12 of the first plug connector 8 (best seen in FIG. 3), a ground shell 24, and a retainer 23 crimped to secure a cable 21. The cable 21 has a braiding 211, and a central conductor 212 electrically connecting with the terminal 25. A pair of tabs 26 depends from opposite sides of the ground shell 24 respectively. When the first plug connector 8 mates with the first receptacle connector 22, the tabs 26 are perpendicular to and overhang the spacer 1.

Figure 3:
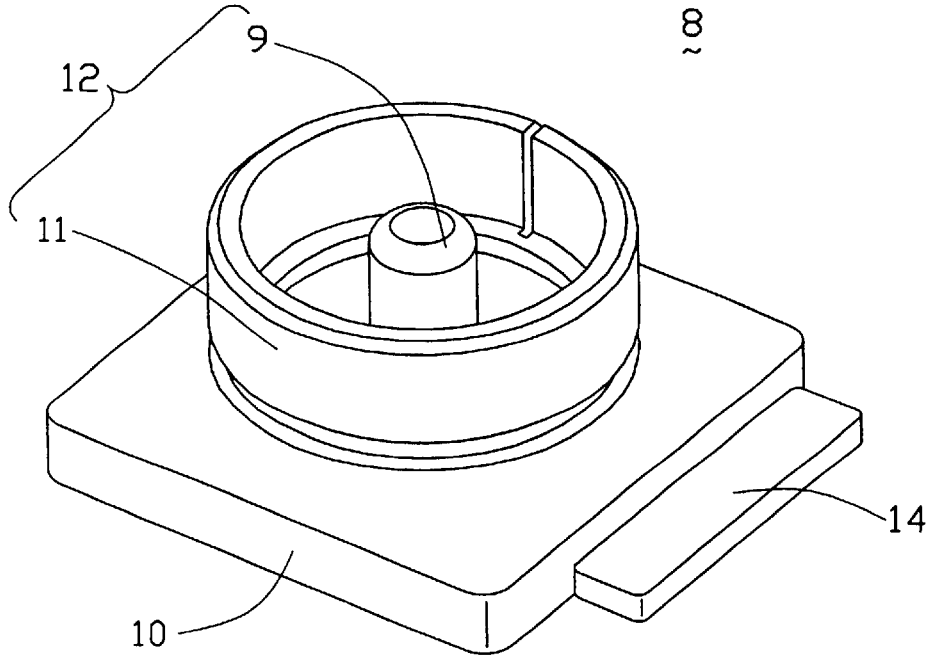
FIG. 3 is a perspective view of a plug connector of the first RF cable connector assembly of FIG. 1.

Referring to FIG. 3, the first plug connector 8 includes an insulative base 10. The base 10 is generally shaped like a flat box. A solder pad 14 is formed at one side of the base 10, for soldering the first plug connector 8 to a printed circuit board (not shown while well-known). The header 12 is made of conductive material, and comprises a cylindrical outer contact 11 and a central pin 9 located within the outer contact 11. A lower portion of the header 12 is embedded in the base 10.

Figure 2:
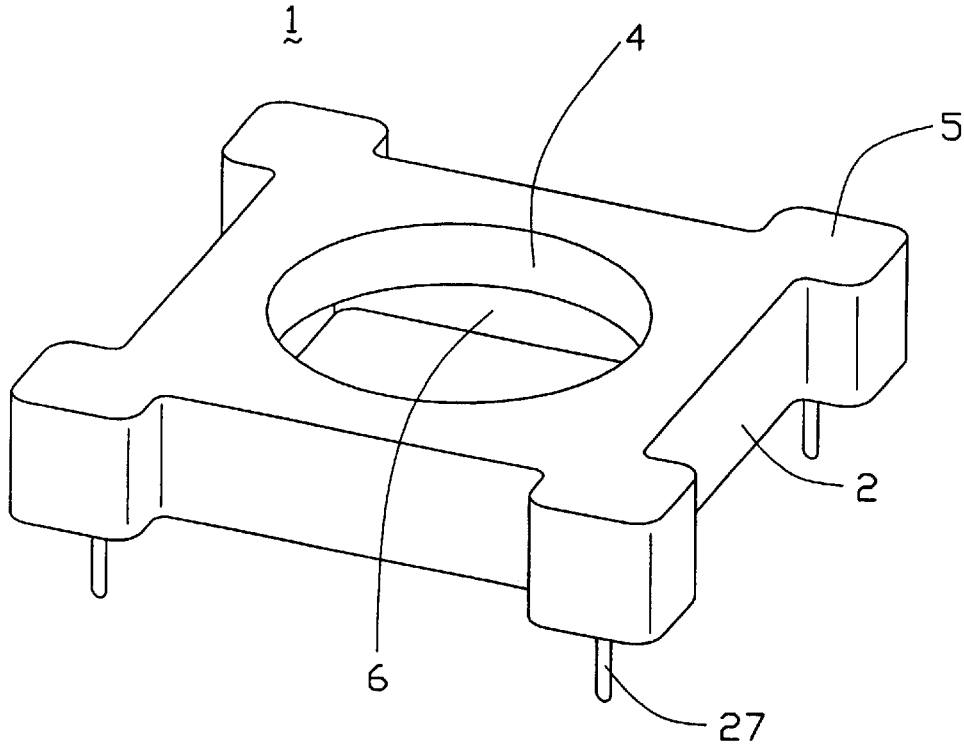
FIG. 2 is a perspective view of the spacer of FIG. 1.

Referring to FIG. 2, the spacer 1 is made of insulative material. A main body 2 of the spacer 1 is generally shaped like a flat box. Four protrusions 5 are respectively formed at four corners of the main body 2. Four solder pins 27 respectively fixedly depend from the four protrusions 5, for soldering the spacer 1 to the printed circuit board (not shown). A through hole (not labeled as such) is defined in a middle of the main body 2. The through hole comprises an upper round hole 4 for receiving the header 12 of the first plug connector 8, and a lower box-shaped cavity 6 for receiving the base 10. The round hole 4 has a diameter larger than a diameter of the outer contact 11. The cavity 6 is slightly larger than the base 10 of the first plug connector 8 so that assembly of the plug connector 8 and the spacer 1 can be easily attained.

Figure 4:
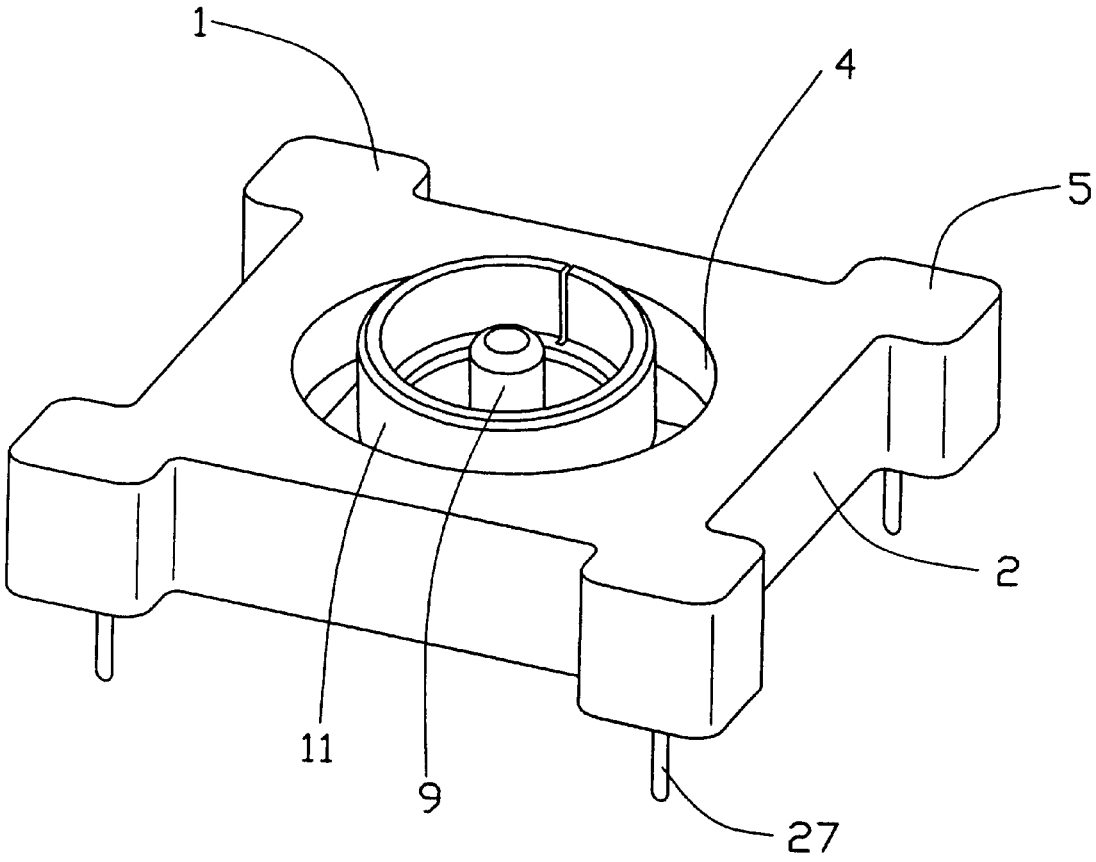
FIG. 4 is a perspective view of the spacer and the plug connector assembled together.

FIG. 4 shows the first plug connector 8 and the spacer 1 assembled together. The assembly is achieved by firstly putting the first plug connector 8 on the printed circuit board (not shown). Then the spacer 1 is mounted onto the first plug connector 8 to a position wherein the base 10 of the plug connector 8 is received in the cavity 6 of the spacer 1, and the header 12 of the first plug connector 8 is received in the round hole 4 of the spacer 1. The outer contact 11 of the header 12 has a diameter less than a diameter of the round hole 4. Therefore, a space (not labeled) is defined between the spacer 1 at a perimeter of the round hole 4 and an outer surface of the outer contact 11 of the header 12. The space (not labeled) receives the terminal 25 of the receptacle connector 22.

Figure 5:
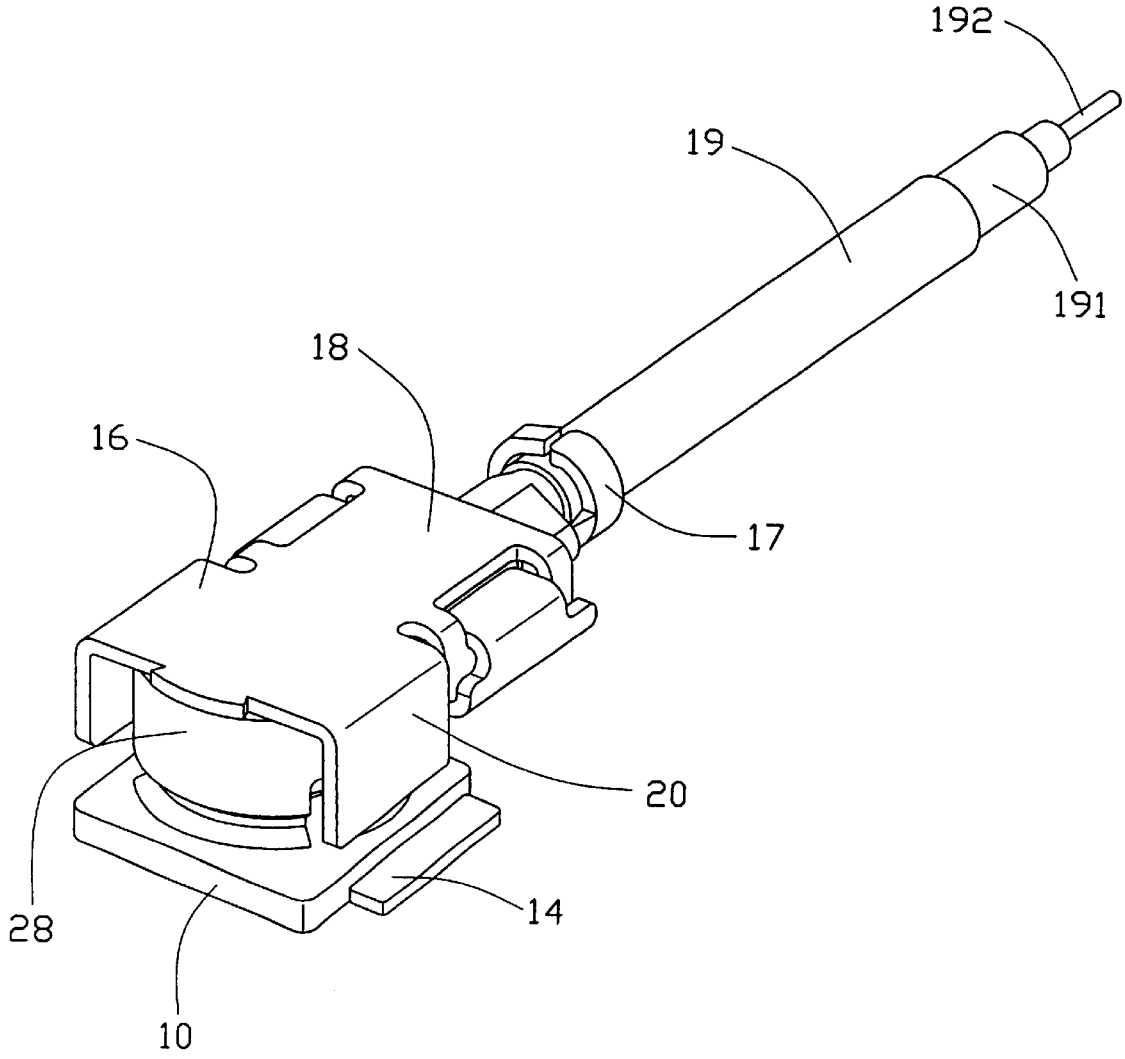
FIG. 5 is a perspective view of a second RF cable connector assembly according to the present invention.

FIG. 5 shows a second RF cable connector assembly in accordance with the present invention, but without a spacer 1. The second RF cable connector assembly comprises a second plug connector (not labeled) which is mechanically identical to the first plug connector 8, and a second receptacle connector 16. The second receptacle connector 16 includes a terminal 28 for mating with a header (not shown) of the second plug connector, a ground shell 18, and a retainer 17 crimped to secure a cable 19. The cable 19 has a braiding 191, and a central conductor 192 electrically connecting with the terminal 28. A pair of tabs 20 depends from opposite sides of the ground shell 18 respectively. The tabs 20 depend further than the tabs 26 of the first receptacle connector 22. When the second plug connector is mated with the second receptacle connector 16, there is no interference. However, when the first plug connector 8 with a spacer 1 is mated with the second receptacle connector 16, the tabs 20 will interfere with the spacer 1. Thus the first plug connector 8 cannot successfully mate with the second receptacle connector 16, and mis-connection is prevented.

It is understood that the invention may be embodied in other forms without departing from the spirit thereof. Thus, the present examples and embodiment are to be considered in all respects as illustrative and not restrictive, and the invention is not to be limited to the details given herein.

I claim:

1. A radio frequency cable connector assembly comprising:

a first cable connector assembly adapted for use in a first frequency, wherein the first cable connector assembly includes a first plug connector, a first receptacle connector and a spacer, the first plug connector includes a conductive header and an insulative base, the first receptacle connector includes a terminal to mate with the header of the first plug connector, a ground shell having a pair of tabs and enclosing the conductive header, and a retainer crimped to secure a cable, and wherein said pair of tabs extends from opposite sides of the ground shell, the spacer is mounted around the first plug connector, and the tabs terminate above the spacer; and a second cable connector assembly adapted for use in a second frequency different from the first frequency, wherein the second cable connector assembly includes a second plug connector and a second receptacle connector, the second plug connector has a mechanical configuration identical to a mechanical configuration of the first plug connector, and the second receptacle connector has a mechanical configuration identical to a mechanical configuration of the first receptacle connector except that a pair of tabs which extend from opposite sides of a ground shell of the second receptacle connector extend longer than the pair of tabs of the first receptacle connector, whereby the second receptacle connector cannot be electrically engaged with the first plug connector due to interference between the tabs of the second receptacle connector and the spacer; wherein the spacer is a box-shaped, the spacer defines a lower cavity and an upper round hole, the base of the first plug connector is received in the cavity, and the head of the first plug connector is received in the round hole; wherein four protrusions are respectively formed at four corners of the spacer, and four solder pins respectively fixedly depend from the four protrusions, the solder pins being adapted for soldering to a printed circuit board.

2. A radio frequency cable connector assembly comprising:

a first receptacle connector having a first electrical contact, and a metallic shield secured around the first electrical contact, the metallic shield having first tabs extending downwardly from opposite sides thereof, each first tab having a first length, the metallic shield also having a cable with a conductor electrically connecting with the first electrical contact;

a first plug connector having an insulative base, a conductive header which is covered by the metal shield and a second electrical contact fixed to and projecting upwardly from the base, the second electrical contact electrically engaging with the first electrical contact;

an insulative spacer mounted around the first plug connector, the spacer defining a central hole through which the second electrical contact of the first plug connector extends;

a second receptacle connector having a third electrical contact, and a metallic shield secured around the third electrical contact, the metallic shield having second tabs extending downwardly from opposite sides thereof, each second tab having a second length greater than the first length of the first tab, the metallic shield also having a cable with a conductor electrically connecting with the third electrical contact; and a second plug connector having an insulative base, a conductive header which is covered by the metallic shield and a fourth electrical contact fixed to and projecting upwardly from the base, the third electrical contact electrically engaging with the fourth electrical contact, the third electrical contact being prevented from being electrically engagable with the second electrical contact by reason of engagement between the at least one second tab and a top face of the spacer; wherein the spacer is a box-shaped, the spacer defines a lower cavity and an upper round hole, the base of the first plug connector is received in the cavity, and the head of the first plug connector is received in the round hole; wherein the spacer has securing means for fixing the spacer to a printed circuit board; wherein the securing means comprise a plurality of solder pins fixed to a bottom face of the spacer.

3. The radio frequency cable connector assembly as described in claim 2, wherein the spacer is generally rectangular, four protrusions radiate from four corners of the spacer, and at least one solder pin is fixed to a bottom of each protrusion.

* * * * *